US005934878A

United States Patent [19]

Yu

[11] Patent Number: 5,934,878

[45] **Date of Patent: *Aug. 10, 1999**

[54] CEILING FAN HOUSING HAVING INNER PANELS

[76] Inventor: Jack Yu, No. 109-1, Avenue 6, Lane 164, Tzong Sa Road, Da Du Hsiang, Taichung Hsien, Taiwan

[ * ] Notice: This patent is subject to a terminal disclaimer.

[21] Appl. No.: 08/919,392

[22] Filed: Aug. 28, 1997

[51] Int. Cl.[6] ..... F04D 29/32; F04D 29/64

[52] U.S. Cl. ..... 416/244 R; 416/5; 362/96; 362/122; 362/355; 362/240; 362/294

[58] Field of Search ..... 416/5, 93 R, 170 R, 416/244 R; 362/96, 453, 454, 355, 806, 122, 240, 149, 294, 373; D23/377, 379, 385, 411; 451/38, 39, 41; 310/89

[56] References Cited

U.S. PATENT DOCUMENTS

| | | | |
|---|---|---|---|
| 1,321,023 | 11/1919 | Framburg | 362/453 |
| 4,363,083 | 12/1982 | Tanaka et al. | 362/294 |
| 4,402,649 | 9/1983 | Laurel | 416/5 |
| 4,626,970 | 12/1986 | Huang | 416/5 |
| 4,858,079 | 8/1989 | Ohashi | 362/806 |
| 4,863,346 | 9/1989 | Lin | 416/5 |
| 5,051,872 | 9/1991 | Anderson | 362/355 |
| 5,404,284 | 4/1995 | Davis, Jr. | 362/294 |
| 5,439,350 | 8/1995 | Yu . | |
| 5,441,387 | 8/1995 | Yu . | |
| 5,454,692 | 10/1995 | Davis | 416/5 |
| 5,503,524 | 4/1996 | Yu . | |
| 5,580,156 | 12/1996 | Suzuki et al. | 362/240 |
| 5,613,753 | 3/1997 | Anderson | 362/355 |
| 5,613,760 | 3/1997 | Dunn | 362/806 |
| 5,655,877 | 8/1997 | Yu | 416/5 |
| 5,672,048 | 9/1997 | Yu | 416/5 |

OTHER PUBLICATIONS

Beverly Hills Fan Company Advertising Flyer, copyright 1993.

*Primary Examiner*—Christopher Verdier
*Attorney, Agent, or Firm*—Charles E. Baxley, Esq.

[57] ABSTRACT

A ceiling fan housing includes a cylindrical member of transparent material and a decorating material layer applied onto the inner peripheral portion of the cylindrical member for decorating purposes. A number of panels are received in the cylindrical member and a number of fastening members engage through the panels and the bottom plate for securing the bottom plate and the cylindrical member and the panels together. The decorating material layer is formed a sand blasting process and includes a number of blank portions for engaging the panels.

3 Claims, 2 Drawing Sheets

CEILING FAN HOUSING HAVING INNER PANELS

BACKGROUND OF THE INVENTION

1. Field of the Invention

The present invention relates to a housing, and more particularly to a ceiling fan housing.

2. Description of the Prior Art

The closest prior art of which applicant is aware are U.S. Pat. Nos: 5,439,350, 5,441,387 and 5,503,524, all issued to Yu who is also the applicant of the present invention. The prior art discloses a ceiling fan housing that includes a number of patterns or panels secured to the cylindrical member. However, the panels are exposed such that gaps are formed between the panels and the cylindrical member and such that the ceiling fan housing may not easily be cleaned.

The present invention has arisen to mitigate and/or obviate the afore-described disadvantages of the conventional ceiling fan housings.

SUMMARY OF THE INVENTION

The primary objective of the present invention is to provide a ceiling fan housing which includes a number of panels secured in a cylindrical member of glass or transparent material for allowing the patterns of the panels to be seen through the transparent cylindrical member.

In accordance with one aspect of the invention, there is provided a housing for a ceiling fan comprising a cylindrical member made of transparent material, the cylindrical member including an upper portion and a bottom plate and including an inner peripheral surface, a decorating material layer applied onto the inner peripheral surface of the cylindrical member for decorating purposes, a cover engaged on the upper portion of the cylindrical member, at least one panel received in the cylindrical member and disposed between the bottom plate and the cover, and a plurality of fastening members engaged through the cover and the panel and the bottom plate for securing the bottom plate and the cylindrical member and the cover together, and for positioning the panel in place in vicinity of and parallel to, and spaced from, the inner peripheral surface of the cylindrical member.

The decorating material layer includes at least one blank portion having a shape corresponding to that of the panel for allowing the panel to be seen through the transparent cylindrical member. The decorating material layer is a sand blasted layer.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
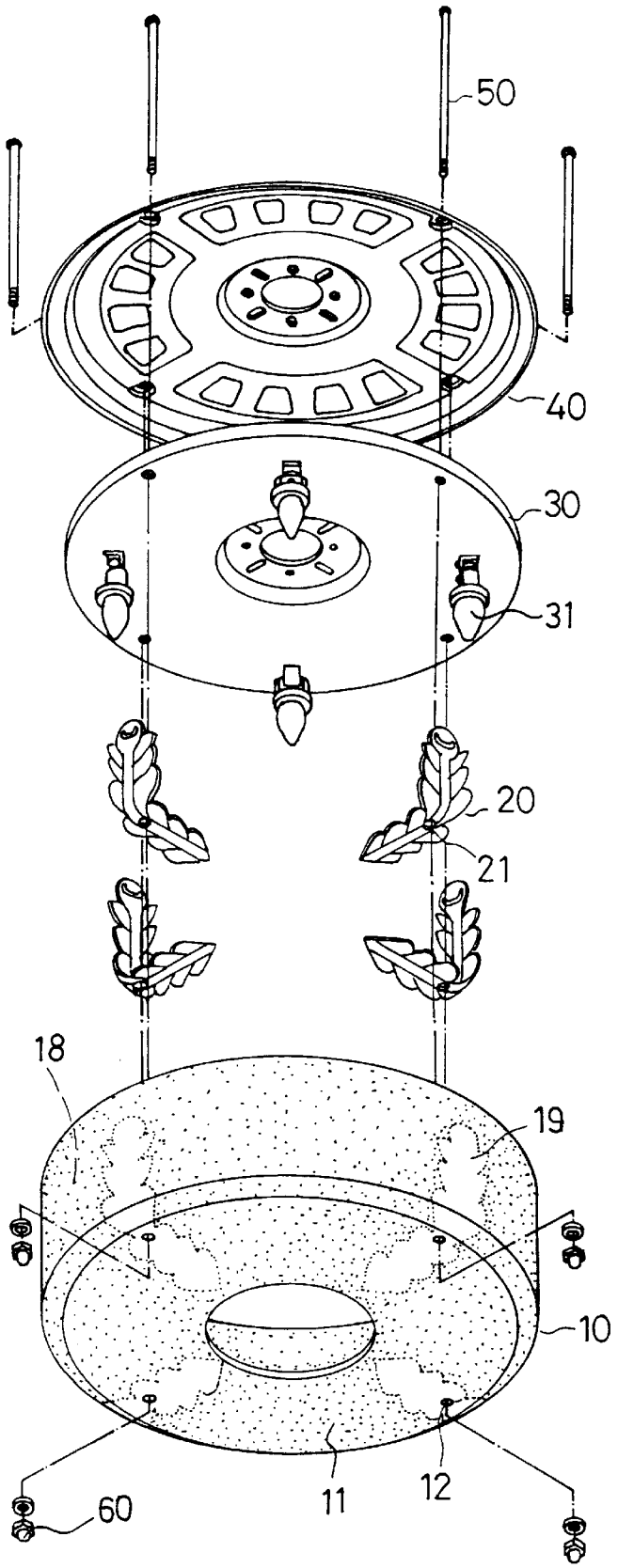
FIG. 1 is an exploded view of a ceiling fan housing in accordance with the present invention.
Figure 2:
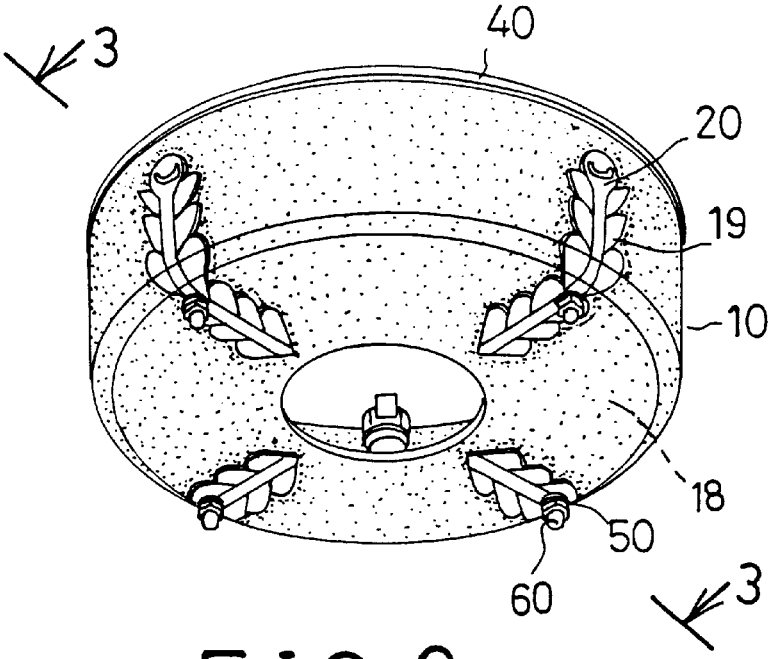
FIG. 2 is a bottom perspective view of the ceiling fan housing.
Figure 3:
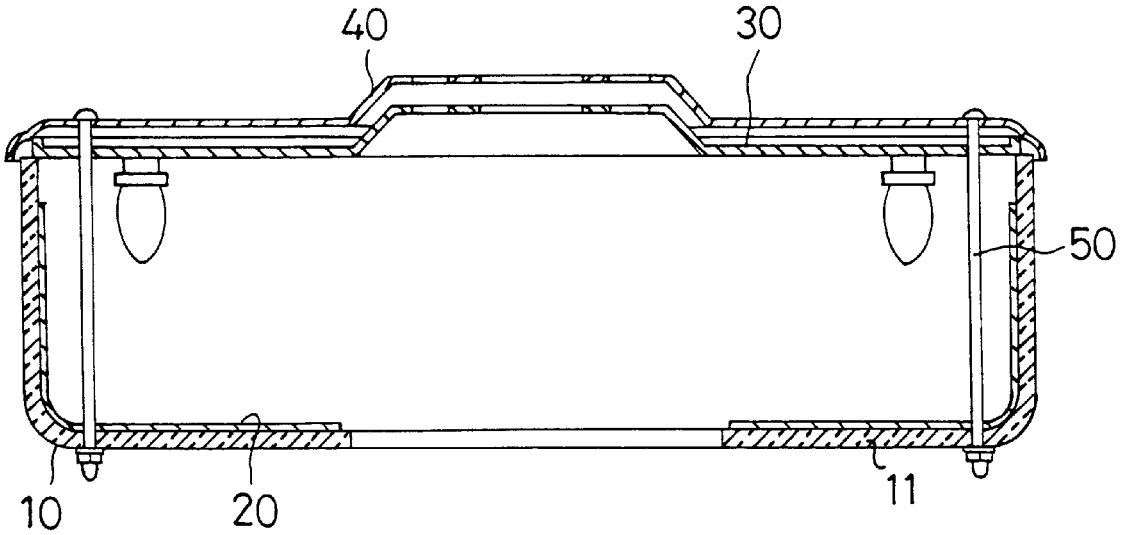
FIG. 3 is a cross sectional view of the ceiling fan housing, taken along lines 3—3 of FIG. 2.

A co-pending U.S. patent application was filed on Aug. 22, 1996, with the Ser. No. 08/701,679, now U.S. Pat. No. 5,672,048 entitled "CEILING FAN HOUSING". The co-pending U.S. patent application is taken as a reference of the present invention.

Referring to the drawings, a ceiling fan housing in accordance with the present invention comprises a cylindrical member 10 including a bottom plate 11 in the form of a peripheral flange extended radially inward from the bottom portion of the cylindrical member 10. The bottom plate 11 includes a number of holes 12 for engaging with bolts 50 which may engage with nuts 60. A board 30 and a cover 40 are engaged on the cylindrical member 10. The board 30 is provided for securing a number of light bulbs 31. A number of panels 20 of suitable patterns are engaged in the cylindrical member 10 and each includes an orifice 21 for engaging with the bolts 50. The bolts 50 are engaged through the cover 40 and the board 30 and the bottom plate 11 of the cylindrical member 10 and are engaged with the nuts 60 so as to secure the cover 40 and the board 30 and the cylindrical member 10 together. The bolts 50 also engage through the panels 20 for securing the panels 20 in place.

It is to be noted that the cylindrical member 10 is made of transparent material, such as glass, for allowing the panels 20 to be seen through the transparent cylindrical member 10. Beautiful lights and shapes may be formed when the light bulbs 31 are energized. It is further to be noted that the bottom plate 11 is not necessarily to be formed integrally with the cylindrical member 10 and may be a separated piece from the cylindrical member 10. The panels 20 preferably are not secured to the cylindrical member 10 so that the cylindrical member 10 will not easily be broken when the cylindrical member 10 is made of glass or other brittle material. The panels 20 may be secured to each other so as to form an integral panel.

The inner peripheral surface of the cylindrical member 10 is provided with an inner layer of decorating material 18, such as formed by sand blasting. The decoration layer 18 defines a number of blank portions 19 each having a shape corresponding to that of corresponding panels 20 for allowing the panels 20 to be seen clearly through the transparent cylindrical member 10. The sand blasted layer 18 further allows beautiful patterns to be generated when the light bulbs 31 are energized. None of the prior ceiling fans provide a transparent cylindrical member having a decorating layer 18 applied to the inner peripheral surface of the cylindrical member.

Accordingly, the ceiling fan housing in accordance with the present invention includes a number of panels secured within the cylindrical member without attachment to the cylindrical member such that the cylindrical member is less vulnerable to being broken, and includes a decoration 18 applied to the inner peripheral surface of the cylindrical member.

Although this invention has been described with a certain degree of particularity, it is to be understood that the present disclosure has been made by a way of example only and that numerous changes in detailed construction and combination and arrangement of parts may be resorted to without departing from a spirit and scope of the invention as hereinafter claimed.

I claim:

1. A housing, for a ceiling fan, and comprising in combination:

a cylindrical member made of transparent material, the cylindrical member including an upper portion and a bottom plate and including an inner peripheral surface;

a decoration layer applied to the inner peripheral surface;

a cover engaged onto the upper portion of the cylindrical member;

at least one panel within the cylindrical member, the at least one panel having an outer decorative portion, the at least one panel disposed between the bottom plate and the cover with the outer decorative portion positioned in vicinity of and parallel to the inner peripheral surface;

a straight fastener bolt for each of the at least one panel, the fastener bolt engaged through a hole formed by the cover and a hole formed by the at least one panel and a hole formed by the bottom plate for securing the bottom plate and the cylindrical member and the cover together, and for the positioning of the outer decorative portion of the at least one panel in the vicinity of and parallel to the inner peripheral surface.

2. The housing as claimed in claim 1, wherein the decoration layer includes at least one blank portion having a shape corresponding to that of a corresponding outer decorative portion of the at least one panel in the vicinity of and parallel to and spaced from the inner peripheral surface for allowing the decorative portion to be seen through the transparent cylindrical member.

3. The housing as claimed in claim 1, wherein the decoration layer is sand blasted.

* * * * *